US012344991B2

(12) United States Patent
Liao et al.

(10) Patent No.: US 12,344,991 B2
(45) Date of Patent: Jul. 1, 2025

(54) DECOLORIZATION METHOD OF POLYESTER FABRIC

(71) Applicant: NAN YA PLASTICS CORPORATION, Taipei (TW)

(72) Inventors: Te-Chao Liao, Taipei (TW); Jung-Jen Chuang, Taipei (TW); Zhang-Jian Huang, Taipei (TW); Yun-Tong Lai, Taipei (TW)

(73) Assignee: NAN YA PLASTICS CORPORATION, Taipei (TW)

( * ) Notice: Subject to any disclaimer, the term of this patent is extended or adjusted under 35 U.S.C. 154(b) by 448 days.

(21) Appl. No.: 17/865,925

(22) Filed: Jul. 15, 2022

(65) Prior Publication Data

US 2023/0082495 A1 Mar. 16, 2023

(30) Foreign Application Priority Data

Sep. 13, 2021 (TW) ..... 110133937

(51) Int. Cl.
*D06L 4/13* (2017.01)
*D06L 4/15* (2017.01)
(Continued)

(52) U.S. Cl.
CPC ..... *D06L 4/13* (2017.01); *D06L 4/15* (2017.01); *D06L 4/22* (2017.01); *D06L 4/30* (2017.01);
(Continued)

(58) Field of Classification Search
None
See application file for complete search history.

(56) References Cited

U.S. PATENT DOCUMENTS 5,356,437 A 10/1994 Pedersen et al.
5,711,764 A 1/1998 Wasinger
(Continued)

FOREIGN PATENT DOCUMENTS

CN 1070970 A 4/1993
CN 104420191 A 3/2015
(Continued)

OTHER PUBLICATIONS

Nippon Kayaku Co., Ltd., "Kayadecolor KP-SP", Dec. 12, 2005, http://web.archive.org/web/20061008032844/http://www.nipponkayaku.co.jp/japan/kagaku/shikizai/adjuvant/adjuvant_pdf/kayadecolor_kpsp.pdf.
(Continued)

*Primary Examiner* — Katie L. Hammer
(74) *Attorney, Agent, or Firm* — Li & Cai Intellectual Property (USA) Office

(57) ABSTRACT

A decolorization method of a polyester fabric includes: providing a polyester fabric, in which the polyester fabric is a dyed polyester fabric and the polyester fabric is adhered with a dye and has a first L value; providing a first decolorizing solution and a second decolorizing solution, in which the first decolorizing solution contains a reductant and the second decolorizing solution contains an oxidant; and performing a decolorization process which includes: using one of the first decolorizing solution and the second decolorizing solution to decolorize one portion of the dye and using another one of the first decolorizing solution and the second decolorizing solution to decolorize another portion of the dye, so that a color of the dye is removed and the polyester fabric is white in color and has a second L value that is greater than the first L value.

7 Claims, 1 Drawing Sheet

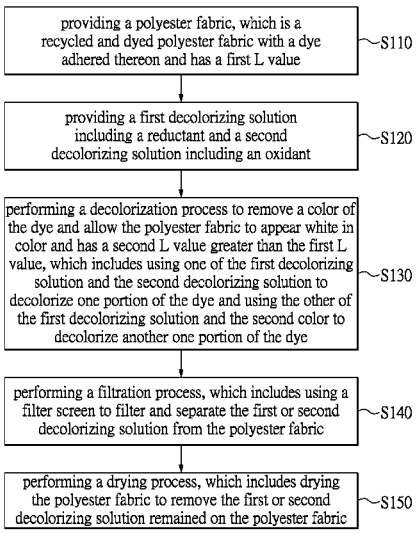

(51) Int. Cl.

| | |
|---|---|
| ***D06L 4/22*** | (2017.01) |
| ***D06L 4/30*** | (2017.01) |
| ***D06L 4/70*** | (2017.01) |
| ***D06L 4/75*** | (2017.01) |
| ***D06P 1/673*** | (2006.01) |
| ***D06P 5/13*** | (2006.01) |
| ***D06P 5/15*** | (2006.01) |

(52) U.S. Cl.
CPC ..... *D06L 4/70* (2017.01); *D06L 4/75* (2017.01); *D06P 5/132* (2013.01); *D06P 5/134* (2013.01); *D06P 5/153* (2013.01); *D06P 5/155* (2013.01); *D06P 1/673* (2013.01); *D06P 1/6735* (2013.01); *D06P 1/67375* (2013.01); *D10B 2331/04* (2013.01)

(56) References Cited

U.S. PATENT DOCUMENTS

| | | | |
|---|---|---|---|
| 7,959,807 | B2 | 6/2011 | Mukai et al. |
| 2002/0193271 | A1 | 12/2002 | LaBeque |
| 2020/0270807 | A1 | 8/2020 | Keh et al. |
| 2022/0356417 | A1 | 11/2022 | Wang et al. |

FOREIGN PATENT DOCUMENTS

| | | | | |
|---|---|---|---|---|
| CN | 108951233 | A | 12/2018 | |
| CN | 110241656 | A | 9/2019 | |
| CN | 111607920 | A | 9/2020 | |
| CN | 113073461 | A | 7/2021 | |
| JP | 54112265 | A | 9/1979 | |
| JP | 319917 | A | 1/1991 | |
| JP | 4108189 | A | 4/1992 | |
| JP | 7189036 | A | 7/1995 | |
| JP | 9296360 | A | 11/1997 | |
| JP | 1088412 | A | 4/1998 | |
| JP | 2001329471 | A | 11/2001 | |
| JP | 2002538268 | A | 11/2002 | |
| JP | 2007254904 | A | 10/2007 | |
| JP | 2007254907 | A | 10/2007 | |
| JP | 200968127 | A | 4/2009 | |
| JP | 2009173732 | A | 8/2009 | |
| JP | 2010126660 | A | 6/2010 | |
| JP | 2012502173 | A | 1/2012 | |
| JP | 2016141909 | A | 8/2016 | |
| JP | 2019183294 | A | 10/2019 | |
| TW | I481762 | B | 4/2015 | |
| TW | 201600675 | A | 1/2016 | |
| WO | WO-9513415 | A1 * | 5/1995 | ..... D06L 3/04 |
| WO | WO2021058023 | A1 | 4/2021 | |

OTHER PUBLICATIONS

Nippon Kayaku Co., Ltd., 2006, http://web.archive.org/web/20061008024053/http://www.nipponkayaku.co.jp/japan/kagaku/shikizai/adjuvant/adjuvant_dk_j.html.

* cited by examiner

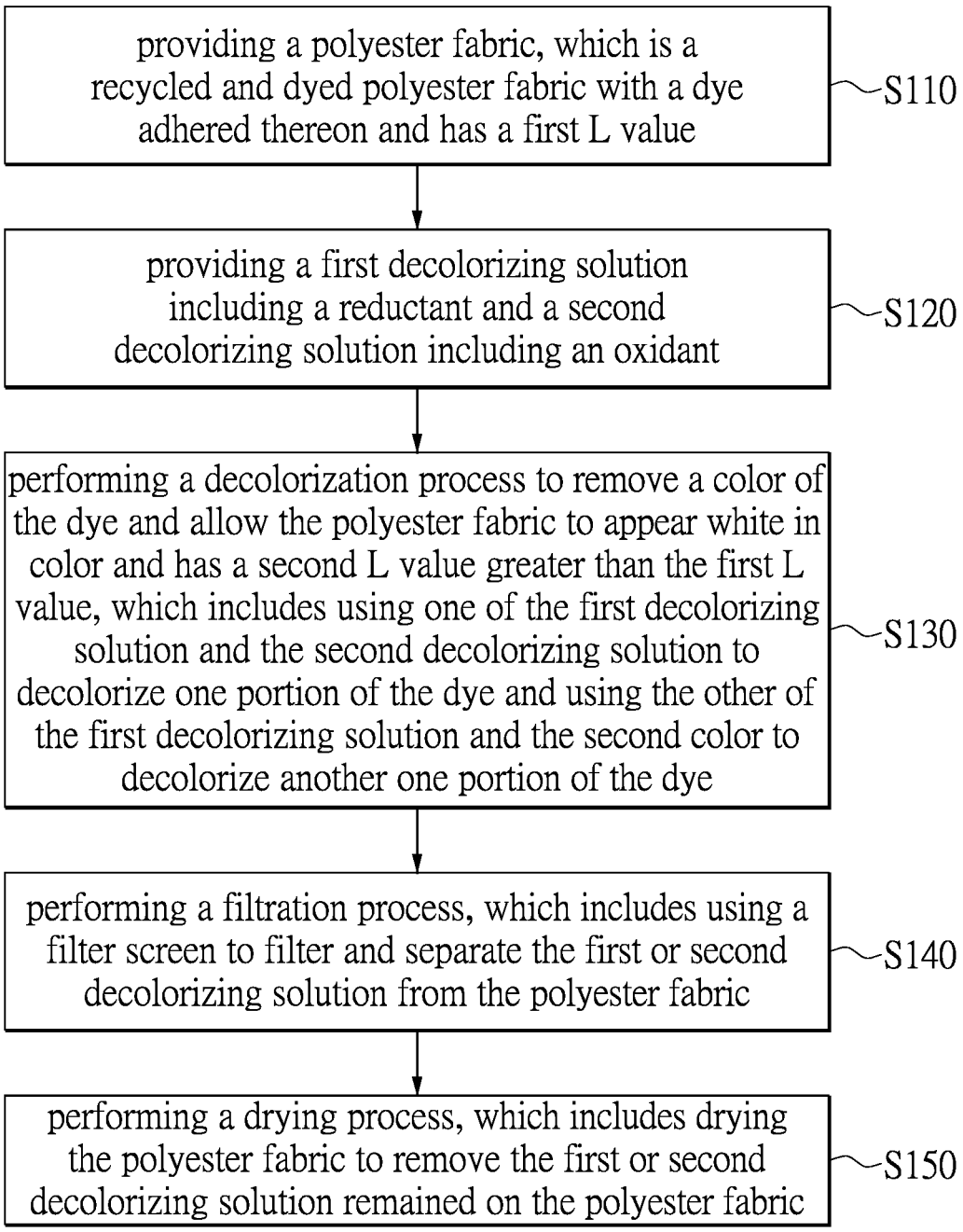
providing a polyester fabric, which is a recycled and dyed polyester fabric with a dye adhered thereon and has a first L value
S110
providing a first decolorizing solution including a reductant and a second decolorizing solution including an oxidant
S120
performing a decolorization process to remove a color of the dye and allow the polyester fabric to appear white in color and has a second L value greater than the first L value, which includes using one of the first decolorizing solution and the second decolorizing solution to decolorize one portion of the dye and using the other of the first decolorizing solution and the second color to decolorize another one portion of the dye
S130
performing a filtration process, which includes using a filter screen to filter and separate the first or second decolorizing solution from the polyester fabric
S140
performing a drying process, which includes drying the polyester fabric to remove the first or second decolorizing solution remained on the polyester fabric
S150

DECOLORIZATION METHOD OF POLYESTER FABRIC

CROSS-REFERENCE TO RELATED PATENT APPLICATION

This application claims the benefit of priority to Taiwan Patent Application No. 110133937, filed on Sep. 13, 2021. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a decolorization method, and more particularly to a decolorization method of a polyester fabric.

BACKGROUND OF THE DISCLOSURE

A material of a polyester fabric is conventionally white in color. In order to increase product marketability, the polyester fabric is aimed to have other colors (e.g., red, yellow, blue, green and black). This can be achieved by the polyester fabric being adhered with a dye through a dyeing and finishing process.

When the polyester fabric is discarded after use, the dye adhered to the polyester fabric needs to be removed or decolorized, so that the polyester fabric can be recycled and reused.

In the related art, the dye is extracted by using one or more organic solvents at a high temperature, so as to remove the dye from the polyester fabric. However, when the dye is removed through use of the organic solvents, an intrinsic viscosity (IV value) of the polyester fabric can be significantly decreased, and a quality of the polyester fabric deteriorates (which is unfavorable for the recycling and reuse of the polyester fabric).

The organic solvents used to extract the dye need to be purified and recovered after use. As a result, there will be costs for recycling the organic solvents. In addition, the organic solvents are usually flammable or explosive and can be dangerous. Therefore, equipment and environments associated with use of the organic solvents need to be explosion-proof. This will increase costs for construction of safety equipment and environments and will increase energy consumption of recycling processes.

U.S. Pat. No. 7,959,807 discloses a method for recovering useful components from a dyed polyester fiber. Although the method has a high dye removal efficiency and allows a recycled polyester fabric to be white in color, the organic solvents used in this method need to be recycled. Further, the IV value of the polyester fabric is significantly decreased, thereby affecting a recycling quality and costs of the polyester fabric.

Taiwan Patent No. 1481762 provides a decolorization method of a dyed polyester fabric, in which an evaporation gas of a solvent is used to extract the dye. Although the method has a high dye extraction efficiency, there is the disadvantage of high energy consumption. Furthermore, the IV value of the polyester fabric is also significantly decreased, such that the quality of the polyester fabric deteriorates.

SUMMARY OF THE DISCLOSURE

In response to the above-referenced technical inadequacies, the present disclosure provides a decolorization method of a polyester fabric.

In one aspect, the present disclosure provides a decolorization method of a polyester fabric. The decolorization method includes: providing a polyester fabric, in which the polyester fabric is a dyed polyester fabric and the polyester fabric is adhered with a dye and has a first L value; providing a first decolorizing solution and a second decolorizing solution, in which the first decolorizing solution contains a reductant and the second decolorizing solution contains an oxidant; and performing a decolorization process which includes: using one of the first decolorizing solution and the second decolorizing solution to decolorize one portion of the dye and using the other of the first decolorizing solution and the second color to decolorize another one portion of the dye, so that a color of the dye is removed and the polyester fabric is white in color and has a second L value that is greater than the first L value.

Preferably, the first decolorizing solution is an aqueous solution that contains the reductant, and the second decolorizing solution is an aqueous solution that contains the oxidant. In the decolorization process, the first decolorizing solution is configured to reduce the one portion of the dye and the second decolorizing solution is configured to oxidize the another one portion of the dye. The first decolorizing solution and the second decolorizing solution alternately decolorize the dye in different steps, so as to completely remove the color of the dye.

Preferably, the reductant of the first decolorizing solution is selected from the group consisting of sodium thiosulfate, sodium dithionite, sodium hydroxymethanesulfinate, thiourea dioxide, sodium hypophosphite, hydrogen, lithium aluminum hydride, sodium borohydride, stannous chloride, zinc, carbon monoxide, and hydrazine. The oxidant of the second decolorizing solution is selected from the group consisting of hydrogen peroxide, ozone, nitric acid, nitrates, potassium permanganate, sodium chlorate, calcium chlorate, chlorates, perchlorates, sodium hypochlorite, calcium hypochlorite, hypochlorites, sodium perborate, perborates, sodium dichromate, and dichromates.

Preferably, a content of the reductant of the first decolorizing solution is between 0.05 wt % and 5 wt %, and the first decolorizing solution is configured to decolorize the polyester fabric at 80° C. to 180° C. A content of the oxidant of the second decolorizing solution is between 0.05 wt % and 5 wt %, and the second decolorizing solution is configured to decolorize the polyester fabric at 80° C. to 180° C.

Preferably, the polyester fabric has a glass transition temperature. In the decolorization process, the first decolorizing solution is heated to a first decolorization temperature to wash and decolorize the polyester fabric. The first decolorization temperature of the first decolorizing solution is between 80° C. and 180° C. and higher than the glass transition temperature of the polyester fabric, so as to enhance a decolorization effect.

Preferably, the second decolorizing solution is heated to a second decolorization temperature to wash and decolorize the polyester fabric. The second decolorization temperature of the second decolorizing solution is between 80° C. and 180° C. and is higher than the glass transition temperature of the polyester fabric, so as to enhance the decolorization effect.

Preferably, in the decolorization process, the dye adhered to the polyester fabric is partially dissolved in the first decolorizing solution and the second decolorizing solution, so as to be partially removed from the polyester fabric. Further, chromophores of another portion of the dye are removed by the first decolorizing solution and/or the second decolorizing solution, so as to achieve the decolorization effect.

Preferably, the first decolorizing solution contains no organic solvent or a trace amount of an organic solvent, and the second decolorizing solution contains no organic solvent or a trace amount of an organic solvent. In the decolorization process, an intrinsic viscosity of the polyester fabric is decreased in a range of not more than 10%. The trace amount of the organic solvent contained in the first decolorizing solution is not more than 10 wt %.

Preferably, in the decolorization process, an amount of the first decolorizing solution or the second decolorizing solution is 5 to 100 times an amount of the polyester fabric, and a washing time of the polyester fabric with the first decolorizing solution or the second decolorizing solution is between 0.2 hours and 6 hours.

Preferably, the first L value of the dyed polyester fabric is not more than 40, and the second L value of the decolorized polyester fabric is no less than 70.

Therefore, in the decolorization method of the polyester fabric provided by the present disclosure, by virtue of "providing a polyester fabric, in which the polyester fabric is a dyed polyester fabric and the polyester fabric is adhered with a dye and has a first L value," "providing a first decolorizing solution that contains a reductant and a second decolorizing solution that contains an oxidant," and "performing a decolorization process which includes: using one of the first decolorizing solution and the second decolorizing solution to decolorize one portion of the dye and using another one of the first decolorizing solution and the second decolorizing solution to decolorize another portion of the dye, so that a color of the dye is removed and the polyester fabric is white in color and has a second L value that is greater than the first L value," the polyester fabric can maintain its quality after decolorization, which is beneficial for recycling and reuse.

Furthermore, in the decolorization method of the polyester fabric provided by the present disclosure, since the dye is decolorized in an aqueous solution system, recycling of the organic solvent is not required. In addition, the decolorization method of the polyester fabric has advantages such as high safety and low energy consumption.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which:

FIG. 1 is a flowchart of a decolorization method of a polyester fabric according to an embodiment of the present disclosure.

DETAILED DESCRIPTION OF THE EXEMPLARY EMBODIMENTS

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

[Decolorization Method of Polyester Fabric]

It should be noted that a material of a polyester fabric is conventionally white in color. In order to increase product marketability, the polyester fabric is aimed to have other colors (e.g., red, yellow, blue, green and black). This can be achieved by the polyester fabric being adhered with a dye through a dyeing and finishing process.

When the polyester fabric is discarded after use, the dye adhered to the polyester fabric needs to be removed or decolorized, so that the polyester fabric can be recycled and reused.

In the related art, the dye is extracted by using one or more organic solvents at a high temperature, so as to remove the dye from the polyester fabric. However, when the dye is removed through use of the organic solvents, an intrinsic viscosity (IV value) of the polyester fabric can be significantly decreased, and a quality of the polyester fabric deteriorates (which is unfavorable for the recycling and reuse of the polyester fabric).

The organic solvents used to extract the dye need to be purified and recovered after use. As a result, there will be costs for recycling the organic solvents. In addition, the organic solvents are usually flammable or explosive and can be dangerous. Therefore, equipment and environments associated with use of the organic solvents need to be explosion-proof. This will increase costs for construction of safety equipment and environments and will increase energy consumption of recycling processes.

Reference is made to FIG. 1. In order to solve the above-mentioned problems, an embodiment of the present disclosure provides a decolorization method of a polyester fabric, which can be used to effectively decolorize the polyester fabric, so that the polyester fabric is white in color. The decolorization method includes step S110, step S120, step S130, step S140, and step S150. It should be noted that a sequence of the steps described in the present embodiment and actual ways of operation can be adjusted according to practical requirements, and are not limited to those described in the present embodiment.

Overall speaking, a dye adhered to the polyester fabric is partially dissolved in a first decolorizing solution and a second decolorizing solution, so that the dye can be partially removed from the polyester fabric. Conventionally, the dye has an unstable molecular structure and a color. The decolorization method provided in the embodiment of the present disclosure can use the first decolorizing solution and the second decolorizing solution to partially dissolve the dye and allow the dye to undergo oxidation and reduction reactions. Accordingly, the molecular structure of the dye can be stabilized, and the color of the dye is removed to become colorless. Furthermore, a dipping temperature of the polyester fabric is higher than a glass transition temperature of the polyester fabric. The polyester fabric can be alternately dipped in an aqueous solution containing a reductant and an aqueous solution containing an oxidant, so that the dye loses its color.

In addition, in a dipping process, since the dipping temperature is higher than the glass transition temperature of the polyester fabric, the dye adhered to the polyester fabric can be released to the aqueous solution and thus removed from the polyester fabric. Moreover, since a liquid used for decolorization in the embodiment of the present disclosure is the aqueous solution, a lower decrease in intrinsic viscosity (e.g., less than 10%) and quality of the polyester fabric can be achieved. More specifically, the aqueous solution has a reductant content of less than 5% and an oxidant content of less than 5%, thereby having the advantage of low costs.

Compared to conventional techniques that use one or more organic solvents to extract the dye of the polyester fabric, the polyester fabric obtained in the embodiment of the present disclosure has the advantages of high quality, high safety, and low costs, such that application fields of recycled polyester fabrics can be expanded. Each step of the decolorization method of the polyester fabric provided in the embodiment of the present disclosure will be described in greater detail below.

Step S110 includes: providing a polyester fabric. The polyester fabric is a recycled and dyed polyester fabric. In addition, the polyester fabric is adhered with a dye and has a first L value.

More specifically, a material of the polyester fabric can be dyed with one or more dyes to have one or more colors (e.g., red, yellow, blue, green, and black) on its surface. The dye is mainly adhered to fiber structures of the polyester fabric, especially non-crystalline areas of the fiber structures. The dye can be at least one of a natural dye and a synthetic dye, or can be at least one of a physical dye and a chemical dye. In one embodiment of the present disclosure, the polyester fabric can be treated with a water repellent to have a water repellent function, but the present disclosure is not limited thereto.

In one embodiment of the present disclosure, the first L value of the dyed polyester fabric is greater than 0 and not more than 40. That is, the dyed polyester fabric has a darker color, but the present disclosure is not limited thereto. It should be noted that the above-mentioned L value is a parameter of a Lab color space that represents lightness (otherwise referred to as whiteness of color).

The decolorization method of the present embodiment includes the following steps, so as to effectively decolorize the dye of the polyester fabric.

Step S120 includes: providing a first decolorizing solution and a second decolorizing solution. The first decolorizing solution includes a reductant, and the second decolorizing solution includes an oxidant.

In one embodiment of the present disclosure, the first decolorizing solution is an aqueous solution including the reductant, and the second decolorizing solution is an aqueous solution including the oxidant, so as to increase safety of a decolorization process and the quality of the polyester fabric.

The first decolorizing solution is an aqueous solution, and the second decolorizing solution is an aqueous solution. That is, the first decolorizing solution and the second decolorizing solution are each a pure aqueous solution system (but the present disclosure is not limited thereto). Therefore, during the decolorization process of the polyester fabric, safety issues such as flammability or explosion do not easily occur. In addition, the intrinsic viscosity of the polyester fabric does not decrease significantly.

The reductant of the first decolorizing solution is selected from the group consisting of sodium thiosulfate (otherwise referred to as sodium hyposulfite or soda), sodium dithionite (also known as sodium hydrosulfite), sodium hydroxymethanesulfinate (also known as Rongalite), thiourea dioxide, sodium hypophosphite, hydrogen, lithium aluminum hydride, sodium borohydride, stannous chloride (tin (II) chloride), zinc, carbon monoxide, and hydrazine. However, the present disclosure is not limited thereto. Any material that can serve as a reductant and enable the dye to undergo the reduction reaction and be decolorized falls within the spirit and scope of the present disclosure.

The oxidant of the second decolorizing solution is selected from the group consisting of hydrogen peroxide (also known as dioxidane), ozone, nitric acid, nitrates, potassium permanganate, sodium chlorate, calcium chlorate, chlorates, perchlorates, sodium hypochlorite, calcium hypochlorite, hypochlorites, sodium perborate, perborates, sodium dichromate, and dichromates. However, the present disclosure is not limited thereto. Any material that can serve as an oxidant and enable the dye to undergo the oxidation reaction and be decolorized falls within the spirit and scope of the present disclosure.

It is worth mentioning that the dye adhered to the polyester fabric cannot be completely removed by using only the oxidant or the reductant. As such, the decolorization method provided in the embodiment of the present disclosure uses both of the first decolorizing solution that contains the reductant and the second decolorizing solution that contains the oxidant to respectively decolorize the dye, so that the dye adhered to the polyester fabric can be completely removed.

In the first decolorizing solution, a content of the reductant is from 0.05 wt % to 5 wt %, and is preferably from 0.1 wt % to 2 wt %, but the present disclosure is not limited thereto. In the second decolorizing solution, a content of the oxidant is from 0.05 wt % to 5 wt %, and is preferably from 0.1 wt % to 2 wt %, but the present disclosure is not limited thereto.

It is worth mentioning that the content of the reductant and the content of the oxidant need to fall within the above-mentioned range, so that the first decolorizing solution and the second decolorizing solution can respectively and effectively decolorize the dye. If the content of the reductant or the oxidant is lower than a lower limit of the above-mentioned range (e.g., lower than 0.05 wt %), the first decolorizing solution or the second decolorizing solution is unable to effectively decolorize the dye. If the content of the reductant or the oxidant is higher than an upper limit of the above-mentioned range (e.g., higher than 5 wt %), problems such as waste of materials and poor dissolution of additives would occur.

The first decolorizing solution is operated at a temperature between 80° C. and 180° C., and preferably between 90° C. and 160° C. The second decolorizing solution is operated at a temperature between 80° C. and 180° C., and preferably between 90° C. and 160° C.

It is worth mentioning that the first or second decolorizing solution is in a liquid phase during the decolorization process, so as to decolorize the dye in the form of a liquid under a high temperature. In this way, a decolorization efficiency of the dye can be increased.

The first or second decolorizing solution is in the liquid phase during the decolorization process, and the aqueous solution contains substances such as the reductant and the oxidant. In one embodiment of the present disclosure, the first or second decolorizing solution can be operated at a high pressure (e.g., between 1 bar and 11 bar), so that the liquid phase of the aqueous solution can be maintained.

Step S130 includes: performing a decolorization process. The decolorization process includes using one of the first decolorizing solution and the second decolorizing solution to decolorize one portion of the dye and using the other of the first decolorizing solution and the second color to decolorize another one portion of the dye. Therefore, a color of the dye can be completely removed, and the polyester fabric is white in color and has a second L value that is greater than the first L value.

In one embodiment of the present disclosure, the second L value of the polyester fabric after the decolorization process is not less than 70, is preferably not less than 75, and is more preferably not less than 85.

More specifically, the first decolorizing solution includes the reactant and the second decolorizing solution includes the oxidant, such that the first decolorizing solution is configured to reduce the one portion of the dye and the second decolorizing solution is configured to oxidize the another one portion of the dye during the decolorization process.

It is worth mentioning that an exothermic reaction occurs when the reactant and the oxidant are mixed together, which can be dangerous and cause a poor decolorization efficiency of the dye. Accordingly, in an exemplary embodiment of the present disclosure, the first decolorizing solution and the second decolorizing solution are configured to decolorize the dye alternately in different steps, so as to completely remove the dye.

Furthermore, between a dye decolorization step of the first decolorizing solution and a dye decolorization step of the second decolorizing solution, the decolorization process can further include a water washing step, so as to clean the reactant or the oxidant remained on the polyester fabric (which is beneficial for a subsequent decolorization step). However, the present disclosure is not limited thereto.

More specifically, the polyester fabric has a glass transition temperature (Tg).

In the decolorization process, the first decolorizing solution is heated to a first decolorization temperature (otherwise referred to as a reductive dipping temperature) to wash and decolorize the polyester fabric. The first decolorization temperature of the first decolorizing solution is between 80° C. and 180° C., and is preferably between 90° C. and 160° C. Furthermore, the first decolorization temperature of the first decolorizing solution is higher than the glass transition temperature of the polyester fabric, and the first decolorizing solution is maintained in a liquid form. In this way, the efficiency of decolorizing the dye adhered to the polyester fabric by the first decolorizing solution can be increased.

The second decolorizing solution is heated to a second decolorization temperature (otherwise referred to as an oxidative dipping temperature) to wash and decolorize the polyester fabric. The second decolorization temperature of the second decolorizing solution is between 80° C. and 180° C., and is preferably between 90° C. and 160° C. Furthermore, the second decolorization temperature of the second decolorizing solution is higher than the glass transition temperature of the polyester fabric, and the second decolorizing solution is maintained in a liquid form. In this way, the efficiency of decolorizing the dye adhered to the polyester fabric by the second decolorizing solution can be increased.

In one embodiment of the present disclosure, the glass transition temperature of the polyester fabric is between 70° C. and 90° C. (e.g., 75° C.).

Since the first and second decolorizing solutions are each heated to a temperature higher than the glass transition temperature of the polyester fabric and lower than a liquid boiling point to perform the decolorization process, the dye adhered to the polyester fabric can be partially dissolved in the first decolorizing solution and the second decolorizing solution, so as to be partially removed from the polyester fabric.

It is worth mentioning that the first and second decolorizing solutions are each an aqueous solution and does not contain an organic solvent. Therefore, the intrinsic viscosity of the polyester fabric is not significantly decreased in the decolorization process. In one embodiment of the present disclosure, a decrease range of the intrinsic viscosity of the polyester fabric in the decolorization process is preferably not more than 20 wt %, and is more preferably not more than 10 wt %.

More specifically, in one embodiment of the present disclosure, an amount of the first decolorizing solution or the second decolorizing solution is 5 to 100 times (preferably 10 to 50 times) an amount of the polyester fabric. In one embodiment of the present disclosure, a washing time of the polyester fabric with the first decolorizing solution or the second decolorizing solution is between 0.2 hours and 6 hours, and is preferably between 0.5 hours and 4 hours. In one embodiment of the present disclosure, a number of times that the polyester fabric is decolorized by the first decolorizing solution or the second decolorizing solution is 1 to 6, and is preferably 2 to 5. It is worth mentioning that in each decolorization process, a new and unused decolorizing solution is used to decolorize the dye, but the present disclosure is not limited thereto.

According to the above-mentioned configuration, the decolorization method of the polyester fabric provided in the embodiment of the present disclosure can prevent the intrinsic viscosity of the polyester fabric from being significantly decreased in the decolorization process. This allows the decolorized polyester fabric to maintain its quality, which is beneficial for recycling and reuse.

Furthermore, in the decolorization method of the polyester fabric provided in the embodiment of the present disclosure, since the dye is decolorized in the aqueous solution system, recycling of the organic solvent is not required. In addition, the decolorization method of the polyester fabric has advantages such as high safety and low energy consumption.

Step S140 includes: performing a filtration process. The filtration process includes using a filter screen to filter and separate the decolorizing solution from the polyester fabric.

In the filtration process, a pore diameter of the filter screen is usually not greater than 3 cm, is preferably not greater than 2 cm, and is more preferably not greater than 1 cm. Therefore, the decolorizing solution (i.e., the first or second decolorizing solution) and the polyester fabric can be effectively separated from each other.

Step S150 includes: performing a drying process. The drying process includes drying the polyester fabric to further remove the residual decolorizing solution (i.e., the first or second decolorizing solution) in the polyester fabric.

In the drying process, the polyester fabric can be placed in an oven or in a dry environment to be dried naturally.

According to the above-mentioned configuration, an L value of the decolorized polyester fabric is not less than 70, is preferably not less than 75, and is more preferably not less than 80. Furthermore, the decolorized polyester fabric has an a value between −5 and 5 and a b value between −10 and 10.

It should be noted that, based on nonlinearly compressed CIE XYZ color space coordinates, a Lab color space is a color-opponent space where a dimension L represents lightness (otherwise referred to as whiteness of color) and a and b represent color-opponent dimensions.

[Experimental Test Data]

To prove that technical effects of having a colorless appearance and the intrinsic viscosity having a decrease range of not more than 20% can be achieved by the decolorization method provided in the embodiment of the present disclosure, the following description will be made with reference to Examples 1-3 and Comparative Examples 1-3.

Example 1

10 g of a PET fabric (L value: 35, intrinsic viscosity: 0.610), 500 ml of water, and 3 g of sodium thiosulfate are put into a 1 L pressure-resistant reaction tank, and are stirred at a temperature of 135° C. for 1 hour. Then, the temperature is decreased to 60° C., and a resulting aqueous solution is discharged from the reaction tank. Afterward, 500 ml of water and 3 g of sodium thiosulfate are put into the reaction tank and stirred at a temperature of 135° C. for 1 hour. Then, the temperature is decreased to 60° C., and a resulting aqueous solution is discharged from the reaction tank. The PET fabric is washed with 300 ml of water before dewatering by centrifugation and drying, so that the PET fabric has an L value of 71 and an intrinsic viscosity of 0.604.

Example 2

Processing steps of Example 2 are the same as those of Example 1. The difference is that 5 g of sodium thiosulfate and 5 g of hydrogen peroxide are added with a same amount of water to decolorize a PET fabric. As a result, the PET fabric has an L value of 75 and an intrinsic viscosity of 0.597.

Example 3

Processing steps of Example 3 are the same as those of Example 1. The difference is that a temperature for decolorization of a PET fabric is changed to 145° C. As a result, the PET fabric has an L value of 73 and an intrinsic viscosity of 0.593.

Comparative Example 1

10 g of a PET fabric (L value: 35, intrinsic viscosity: 0.610) and 500 ml of toluene are put into a 1 L pressure-resistant reaction tank, and are stirred at a temperature of 105° C. and a pressure of 1 bar for 2 hours. The temperature is then decreased to 30° C., and the toluene is discharged from the reaction tank. Afterward, the PET fabric is sequentially washed with 500 ml of acetone and 50,000 ml of water before dewatering by centrifugation and drying, so that the PET fabric has an L value of 73 and an intrinsic viscosity of 0.544.

Comparative Example 2

Processing steps of Comparative Example 2 are the same as those of Comparative Example 1. The difference is that p-xylene is used instead of toluene, and a temperature for decolorization of a PET fabric is changed from 105° C. to 125° C. As a result, the PET fabric has an L value of 75 and an intrinsic viscosity of 0.532.

Comparative Example 3

Processing steps of Comparative Example 3 are the same as those of Comparative Example 1. The difference is that ethylene glycol is used instead of toluene, and a temperature for decolorization of a PET fabric is changed from 105° C. to 145° C. As a result, the PET fabric has an L value of 74 and an intrinsic viscosity of 0.516.

Beneficial Effects of the Embodiments

In conclusion, the in the decolorization method of the polyester fabric provided by the present disclosure, by virtue of "providing a polyester fabric, in which the polyester fabric is a dyed polyester fabric and the polyester fabric is adhered with a dye and has a first L value," "providing a first decolorizing solution that contains a reductant and a second decolorizing solution that contains an oxidant," and "performing a decolorization process which includes: using one of the first decolorizing solution and the second decolorizing solution to decolorize one portion of the dye and using another one of the first decolorizing solution and the second decolorizing solution to decolorize another portion of the dye, so that a color of the dye is removed and the polyester fabric is white in color and has a second L value that is greater than the first L value," the polyester fabric can maintain its quality after decolorization, which is beneficial for recycling and reuse. Furthermore, in the decolorization method of the polyester fabric provided by the present disclosure, since the dye is decolorized in an aqueous solution system, recycling of the organic solvent is not required. In addition, the decolorization method of the polyester fabric has advantages such as high safety and low energy consumption.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A decolorization method of a polyester fabric, comprising:

providing a polyester fabric, wherein the polyester fabric is a dyed polyester fabric, and the polyester fabric is adhered with a dye and has a first L value;

providing a first decolorizing solution and a second decolorizing solution, the first decolorizing solution containing a reductant, and the second decolorizing solution containing an oxidant; and performing a decolorization process which includes;

heating the first decolonizing solution to a first decolorization temperature to decolorize one portion of the dye adhered on the polyester fabric, wherein the first decolonization temperature is between 135° C. and 180° C., first decolorization temperature is higher than a glass transition temperature of the polyester fabric, and the first decolorizing solution is maintained at a liquid phase in a pressure-resistant reaction tank;

discharging the first decolorizing solution from the pressure-resistant reaction tank;

heating the second decolorizing solution to a second decolorization temperature to decolorize another portion of the dye adhered on the polyester fabric, wherein the second decolorization temperature is between 135° C. and 180° C. the second decolonization temperature is higher than the glass transition temperature of the polyester fabric, and the second decolonizing solution is maintained at the liquid phase in the pressure-resistant reaction tank; and discharging the second decolorizing solution from the pressure-resistant reaction tank;

wherein, after the decolorization process, the polyester fabric has a second L value that is greater than the first L value, and an intrinsic viscosity of the polyester fabric is decreased not more than 10%.

2. The decolorization method according to claim 1, wherein the first decolorizing solution is an aqueous solution that contains the reductant, and the second decolorizing solution is an aqueous solution that contains the oxidant; wherein in the decolorization process, the first decolorizing solution is configured to reduce the one portion of the dye, and the second decolorizing solution is configured to oxidize the another portion of the dye; wherein the first decolorizing solution and the second decolorizing solution alternately decolorize the dye in different steps, so as to completely remove the color of the dye.

3. The decolorization method according to claim 2, wherein the reductant of the first decolorizing solution is at least one selected from the group consisting of sodium thiosulfate, sodium dithionite, sodium hydroxymethanesulfinate, thiourea dioxide, sodium hypophosphite, hydrogen, lithium aluminum hydride, sodium borohydride, stannous chloride, zinc, carbon monoxide, and hydrazine; wherein the oxidant of the second decolorizing solution is at least one selected from the group consisting of hydrogen peroxide, ozone, nitric acid, nitrates, potassium permanganate, sodium chlorate, calcium chlorate, chlorates, perchlorates, sodium hypochlorite, calcium hypochlorite, hypochlorites, sodium perborate, perborates, sodium dichromate, and dichromates.

4. The decolorization method according to claim 2, wherein a content of the reductant of the first decolorizing solution is between 0.05 wt % and 5 wt %, and a content of the oxidant of the second decolorizing solution is between 0.05 wt % and 5 wt %.

5. The decolorization method according to claim 2, wherein the first decolorizing solution contains no organic solvent or no more than 10 wt % of an organic solvent, and the second decolorizing solution contains no organic solvent or no more than 10 wt % of an organic solvent.

6. The decolorization method according to claim 2, wherein in the decolorization process, an amount of the first decolorizing solution or the second decolorizing solution is 5 to 100 times an amount of the polyester fabric, and a washing time of the polyester fabric with the first decolorizing solution or the second decolorizing solution is between 0.2 hours and 6 hours.

7. The decolorization method according to claim 1, wherein the first L value of the dyed polyester fabric is not more than 40, and the second L value of the polyester fabric after the decolorization process is not less than 70.

* * * * *